United States Patent [19]

Tarusawa

[11] 4,201,043

[45] May 6, 1980

[54] WRISTWATCH CALCULATOR IMPUT KEY POSITIONING ASSEMBLY

[75] Inventor: Yasutaka Tarusawa, Suwa, Japan

[73] Assignee: Kabushiki Kaisha Suwa Seikosha, Tokyo, Japan

[21] Appl. No.: 817,779

[22] Filed: Jul. 21, 1977

[30] Foreign Application Priority Data

Jul. 16, 1976 [JP] Japan ..... 51-94852[U]

[51] Int. Cl.[2] ..... H01H 9/00; G04C 3/00

[52] U.S. Cl. ..... 368/10; 200/5 A; 368/294

[58] Field of Search ..... 200/5 A, 159 B, 340, 200/86 R, 302; 58/152 R, 85.5, 85, 50 R; 364/705, 709

[56] References Cited

U.S. PATENT DOCUMENTS

| | | | |
|---|---|---|---|
| 3,584,162 | 6/1971 | Krakinowski | 200/5 A |
| 3,699,294 | 10/1972 | Sudduth | 200/159 B X |
| 3,783,205 | 1/1974 | Boulanger | 200/159 B X |
| 3,803,834 | 4/1974 | Reese | 58/152 R |
| 3,898,421 | 8/1975 | Suzumura | 200/5 A X |
| 3,928,960 | 12/1975 | Reese | 58/152 R |
| 3,932,722 | 1/1976 | Obata et al. | 200/5 A X |
| 3,973,099 | 8/1976 | Morris, Jr. | 58/85.5 X |
| 4,007,364 | 2/1977 | Ojima et al. | 200/5 A X |
| 4,019,037 | 4/1977 | Monna | 58/50 R X |
| 4,028,509 | 6/1977 | Zurcher | 200/86 R X |
| 4,062,181 | 12/1977 | Zurcher | 58/152 |
| 4,072,004 | 2/1978 | Tanaka et al. | 200/159 B X |
| 4,128,889 | 12/1978 | Ojima et al. | 200/5 A X |

OTHER PUBLICATIONS

Ludeman, C. P. et al.; IBM Tech. Disc. Bull.; "Wrist-worn Terminal"; vol. 15, No. 11, Apr. 1973, pp. 3350, 3351.

*Primary Examiner*—James R. Scott

*Attorney, Agent, or Firm*—Blum, Kaplan, Friedman, Silberman & Beran

[57] ABSTRACT

An input key positioning assembly for use in an electronic device having multi-input terminals therein. An input key formed with a flange is secured in a stepped opening in a first member so as to be downwardly and upwardly movable between the stepped portion of the first member and a second member formed with an opening smaller than the larger portion of the stepped opening and partially closing said larger portion of said stepped opening. A resilient packing positioned between the keys and a multi-input terminal is formed with projections for returning each key to its original position and for actuating the associated terminal. Said first member may be the cover glass of an electronic wristwatch with a calculator therein, while said second member may be a display plate for identifying the function of said keys.

8 Claims, 3 Drawing Figures

FIG. 2
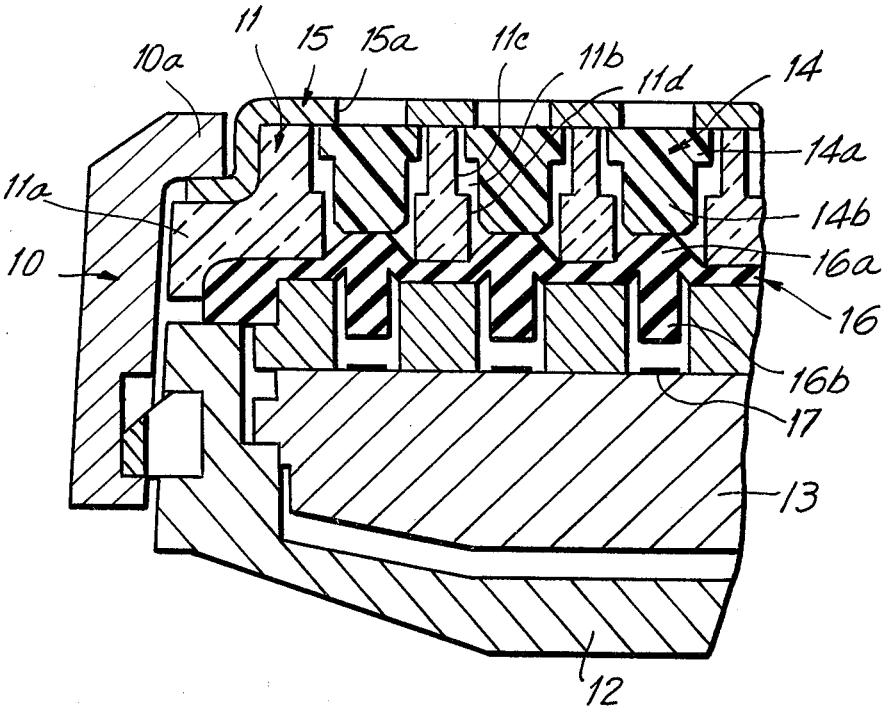
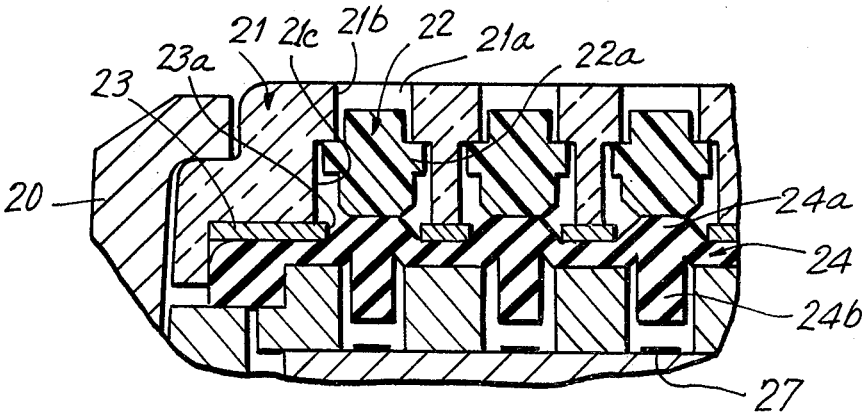
FIG. 3

WRISTWATCH CALCULATOR IMPUT KEY POSITIONING ASSEMBLY

BACKGROUND OF THE INVENTION

This invention relates generally to an improved input key positioning assembly, and in particular to an improved input key positioning assembly for use in an electronic wristwatch having a calculator therein.

Small electronic devices such as calculators and digital watches having multi-input means have become popular recently. Included are digital display electronic wristwatches having multiple functions therein, such as, a calculator, chronograph, world time and alarms. Such devices may have as many as twenty or more input keys. In conventional constructions, a stop ring is used to secure each key in position in an opening in the top surface. When as many as twenty keys are provided in the wristwatch, a large number of operations are required to form the stop rings and assemble the moveable parts of the device. Thus, the cost of manufacturing and assembling the devices has become great.

SUMMARY OF THE INVENTION

Generally speaking, in accordance with the invention, an input key positioning assembly for positioning operational keys in an electronic device having multi-input terminals is provided which overcomes the disadvantages of prior conventional means. An assembly constructed and arranged in accordance with the invention includes a flanged input key for controlling downward and upward displacement of the key between a stepped opening of a first member of the device and a second member formed with a smaller opening than the larger portion of the stepped opening and positioned so as to partially close said larger portion of said stepped opening. A resilient packing member is positioned in the device between the key and the multi-input terminals for actuating each of said multi-input terminals in response to the downward displacement of the associated key.

Accordingly, it is an object of this invention to provide an improved assembly for positioning input keys in an electronic device.

Another object of the invention is to provide an improved assembly for positioning input keys in an electronic wristwatch having multi-input means actuated by depressing an input key.

A further object of the invention is to provide an improved assembly for positioning input keys in an electronic device having a unitary packing sheet therein.

Still another object of the invention is to provide an improved assembly for positioning input keys in an electronic wristwatch having a calculator therein.

Another object of the invention is to provide an improved assembly for positioning input keys in an electronic device which facilitates assembly of such devices.

Still other objects and advantages of the invention will in part be obvious and will in part be apparent from the specification and drawings.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2 is a partial cross-sectional view of the keyboard portion of an electronic wristwatch constructed and arranged in accordance with an embodiment of the invention; and FIG. 3 is a partial cross-sectional view of the input portion of an electronic wristwatch constructed and arranged in accordance with another embodiment of the invention.

DESCRIPTION OF THE PREFERRED EMBODIMENTS

Figure 1:
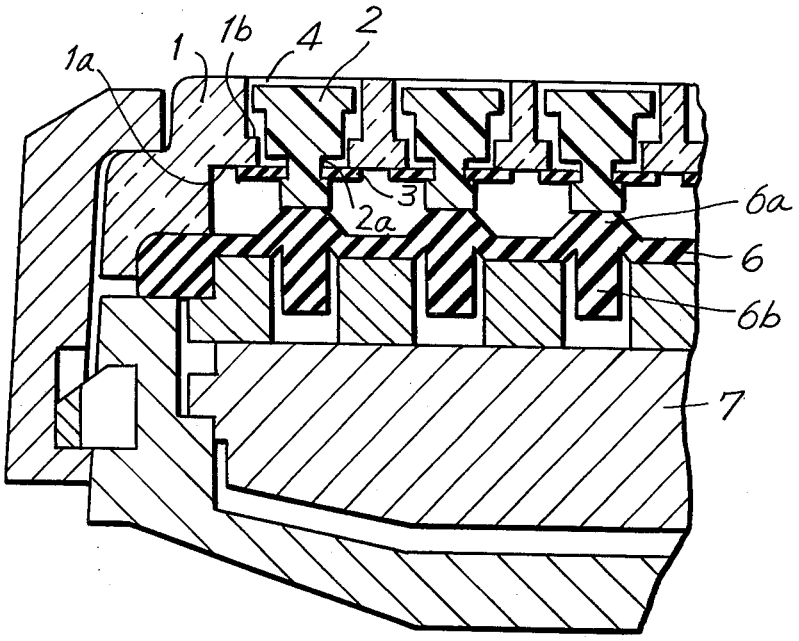
FIG. 1 PRIOR ART
FIG. 1 is a partial cross-sectional view of the keyboard portion of an electronic wristwatch having a calculator therein, showing the construction of a conventional assembly for positioning input keys in an electronic wristwatch.

Referring now to FIG. 1, an electronic wristwatch with a calculator therein having a conventional assembly for positioning input keys therein is shown. A watch cover glass 1 is formed with a plurality of holes 4 for positioning operational input key 2. Cover glass holes 4 are formed with a stepped portion **1*b* at its lower surface 1*a*. An input key 2 is formed with an upper peripheral flange 2*c* for preventing key 2 from being pushed through cover glass 1 into the interior of the watch case. A stop ring 3 is provided for each input key 2 and fixed along the lower surface 1*a* of cover glass 1. Each operational key 2 is formed further with a groove 2*a* in its lower portion for engaging stop ring 3 so that key 2 will be secured in its opening in cover glass 1 and not be released from the top surface of cover glass 1. A unitary packing sheet 6 of a resilient material is formed with projections 6*a* provided beneath operational keys 2 for making electrical contact with or otherwise actuating terminals on watch and calculator body 7 and for returning key 2 to its original position. Operational contact with said temrinals is made by fingers 6*b*, each finger being displaced by the associated key 2. At least the end of each finger may be formed of a conductive material for this purpose. Each stop ring 3 is formed with a watch in plan view (not shown) to permit mounting in the groove 2*a* of associated key 2**.

According to this conventional assembly, a stop ring is required for each opening and input key. In an electronic wristwatch with a calculating function, there may be twenty or more keys and, thus, a similar number of stop rings are required. In such cases, cost of manufacture becomes high with many assembly steps resulting in undesirable manner of construction.

Referring now to FIG. 2, a partial cross-sectional view of the keyboard portion of an electronic wristwatch having an input key positioning assembly constructed and arranged in accordance with the invention is shown. A watch case 10 is formed with an opening defined by a peripheral flange **10*a* for receiving a cover glass 11 thereunder. A watch and calculator body 13 containing the watch and calculator circuitry therein is mounted in watch case 10 from the back side. A case back 12 is mounted releasably in watch case 10 for securing body 13 and closing watch case 10**.

Cover glass 11 is formed with at least two stepped openings **11*b* therethrough, each stepped opening for receiving and positioning an input key 14. Stepped openings 11b are substantially cylindrical in shape with a larger upper portion 11c and a smaller lower portion 11d sized to permit lower portion 14b of input key 14 to pass therethrough. Each input key 14 is substantially cylindrical in shape and is formed with an upper peripheral flange 14a of smaller diameter than upper portion 11c and larger than lower portion 11d of stepped opening 11b. A panel 15, formed with at least two openings 15a of smaller diameter than upper portion 11d and positioned to overlie stepped openings 11b, is fixed to the top surface of cover glass 11 over the keyboard portion of the wristwatch and extending to periphery 11a of cover glass 11. When cover glass 11 is inserted under watch case peripheral flange 10a, panel 15 is compressed between cover glass periphery 11a and peripheral lip 10a of watch case 10. Panel 15 may carry the numerical and operational data identifying input keys 14. Alternatively, this information may be carried on the top surface of each input key. When assembling the wristwatch, input keys 14 are inserted in stepped openings 11b from the top side of cover glass 11 prior to fixing panel 15 to the top surface of cover glass 11. Panel 15 is fixed to cover glass 11** by adhesive or other suitable means.

A unitary packing sheet 16 of a resilient material formed with projections 16a on its upper surface is positioned beneath the keyboard region in watch case 10. Projections 16a are formed to register with the base of input keys 12 and force input keys 12 to their respective at rest positions against the lower surface of panel 15. Packing sheet 16 is formed further with fingers 16b on the underside of and projecting from the base of each projection 16a for contacting terminals 17 located on watch and calculator body 13 to actuate same and provide input to the calculator portion of watch and calculator body 13. There are as many projections 16a and fingers 16b as there are input keys 14 and terminals 17.

When input key 14 positioned in an assembly of the invention is depressed by a user, finger 16b makes contact with the respective terminal 17, key 14 having travelled downwardly until flange 14a abuts the stepped portion of stepped opening 11b. Key 14 cannot be pushed through stepped opening 11b into the interior of the watch case 10. Upon release of pressure, key 14 returns to its original position by pressure from projection 16a of packing 16 until the top of flange 14a abuts the bottom side of panel 15. Key 14 will not be released through the top surface of cover glass 11 due to this arrangement between flange 14a and panel 15.

By constructing and arranging stepped openings 11b, flanged input keys 14 and panel 15 in this manner, each input key 14 is displaceable downwardly and upwardly in its stepped opening 11b. Thus, the displacement distance of key 14 is regulated and resilient force from projections 16a return each input key 14 to its original position after pressure is released by a user.

Referring now to FIG. 3, another embodiment of the input key positioning assembly for use in an electronic wristwatch having a calculator therein constructed and arranged in accordance with the invention is shown. In this embodiment, a watch case 20 secures a cover glass 21 in the same manner as described with respect to the wristwatch of FIG. 2. Cover glass 21 is formed with at least two substantially cylindrical stepped openings 21a, each having a smaller upper portion 21b and a larger lower portion 21c, for receiving and positioning a substantially cylindrical shaped input key 22. Each input key 22 is formed with a flange 22a thereabout to fit into larger portion 21c of stepped opening 21a.

A panel 23 formed with at least two openings 23a is provided along the lower surface of cover glass 21 with opening 23a formed with a smaller diameter than lower portion 21c positioned at the base of each stepped opening 21a. Panel 23 may carry the numerical or operational identifying data for input keys 22. Alternatively, this data may be carried on the top surface of keys 22. When assembling the wristwatch in accordance with this embodiment, input keys 22 are inserted into stepped openings 21a from the lower side of cover glass 21 prior to fixing panel 23 to the lower surface of cover glass 21.

A unitary packing sheet 24 is provided which is formed with at least two projections 24a formed in its top surface to register with a base of each input key 22. Packing sheet 24 is formed further with at least two fingers 24b formed from the base of projections 24a for providing electrical contact with a plurality of terminals 27 provided in a watch and calculator body 25. Packing sheet 24 is formed from a resilient material which forces each multi-input key to its upper at rest position abutting the stepped portion of stepped openings 21a of cover glass 21.

When input key 22 positioned in an assembly of the inventon is depressed by a user, finger 24b contacts a terminal as described with respect to FIG. 2. Key 22 travels downwardly until flange 22a abuts the top surface of panel 23 preventing input key 22 from being pushed out of stepped opening 21a into the interior of watch case 20. Similarly, upper portion 21b of stepped opening 21a prevents input key 22 from being released through the top of cover glass 21 when key 22 is forced upwardly by sheet 24.

Accordingly, an input key positioning assembly constructed and arranged in accordance with the invention utilizes a flange formed on the key to restrict the downward and upward displacement of the key between a panel and the stepped portion formed in the cover glass opening. This arrangement eliminates the need for providing individual stop rings which fit into a separate groove formed about each input key provided. This represents a significant savings in manufacture and assembly time when as many as twenty individual input keys are provided. The input key positioning assembly of the invention is suitable for use in an electronic wristwatch having a calculator therein or may be employed for use in other wristwatch functions such as chronograph, world time and electronic alarms. The electronic wristwatches having a calculator therein may be of the light emitting diode type, liquid crystal display type or other suitable displays. In addition, the input key positioning assembly may also be utilized in other electronic devices, such as pocket calculators.

It will thus be seen that the objects set forth above, among those made apparent from the preceeding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An assembly for positioning an input key in an opening through an exterior case of an electronic device having input means to be actuated by said key, comprising a first case member formed with a stepped opening having a larger portion and a smaller portion and positioned in registration with said input means, the larger portion on the side of said first case member away from said input means, an input key positioned in said stepped opening, said key dimensioned to fit through said smaller portion of said stepped opening and formed with flange means of a lateral dimension larger than the coresponding lateral dimension of said smaller portion and dimensioned for receipt in said larger portion of said stepped opening, a second case member formed with an opening of smaller size than said larger portion of said stepped opening and positioned at a side of said first case member where said second case member opening is in registration with and partially closes said larger portion of said stepped opening, said second case member defining the exterior of the device, and biasing means for biasing said key away from said input means abutting said second case member, whereby said key flange may be axially displaced in said larger portion of said stepped opening between said smaller portion of said stepped opening and said second case member.

2. The assembly of claim 1, wherein said biasing means is a resilient packing means formed with a projection projecting toward said key for registering with the base of said key for biasing said key toward the exterior of said device to an original position away from said input means.

3. The assembly of claim 2, wherein said resilient packing means is formed with a finger projecting from said projection towards said input means, whereby manipulation of said key in said stepped opening in said first member displaces said finger to said input means for actuation of said input means, said key and finger returning to their original positions upon release of said key due to resiliency of said packing means.

4. A digital display electronic wristwatch having a calculator therein, comprising a watch and calculator body means including multi-input means; watch case means for receiving said watch and calculator body means and a cover glass mounted in said watch case means including at least two stepped openings therethrough; each stepped opening formed with a larger portion and a smaller portion and positioned in registration with an input of said multi-input means; the larger portion of said stepped openings formed on the outer surface of said cover glass; a panel formed with at least two openings of smaller size than said larger portion of said stepped openings and positioned on said cover glass so that each said panel opening is in registration with and partially closes the larger portion of a stepped opening through said cover glass; a key member formed with a flange and mounted for displacement in each of said watch case means stepped openings, said flange having a lateral dimension larger than a corresponding lateral dimension of said smaller portion of said stepped opening and being dimensioned for receipt in the larger portion thereof; and a unitary resilient packing sheet means for biasing said key to a first position away from said multi-input means by the displacement of said key members through said openings to effect selective actuation of said multi-input means.

5. The wristwatch of claim 4, wherein said flange is a peripheral flange along the top surface of said key.

6. The assembly of claim 4, wherein said panel is a display panel carrying identifying indicia associated with each key for viewing by a user of the wristwatch.

7. The assembly of claim 6, wherein the peripheral portion of said panel is compressively retained between said watch case means and said cover glass.

8. The assembly of claim 4, wherein the peripheral portion of said second case member is compressively retained between said watch case means and said cover glass.

* * * * *